US005570592A

United States Patent [19]

Takegawa

[11] Patent Number: 5,570,592

[45] Date of Patent: Nov. 5, 1996

[54] SINKER ACTUATING APPARATUS HAVING SPRING FORCE ADVANCING MEMBER

[75] Inventor: Yujiro Takegawa, Ishikawa-ken, Japan

[73] Assignee: Tsudakoma Kogyo Kabushiki Kaisha, Kanazawa, Japan

[21] Appl. No.: 555,484

[22] Filed: Nov. 8, 1995

[30] Foreign Application Priority Data

Nov. 16, 1994 [JP] Japan ..... 6-305675

[51] Int. Cl.[6] ..... D04B 15/06

[52] U.S. Cl. ..... 66/64; 66/60 R; 66/106

[58] Field of Search ..... 66/60 R, 64, 66, 66/72, 106, 107, 109

[56] References Cited

U.S. PATENT DOCUMENTS

| | | | |
|---|---|---|---|
| 321,733 | 7/1885 | Levy | 66/72 A |
| 2,893,225 | 7/1959 | Kuntz | 66/64 |
| 2,960,854 | 11/1960 | Eberl | 66/60 X |
| 2,972,242 | 2/1961 | Eberl | 66/64 X |
| 3,326,017 | 6/1967 | Tschumperlin | 66/64 |
| 3,440,839 | 4/1969 | Tschumperlin | 66/64 |
| 5,134,865 | 8/1992 | Shima et al. | 66/106 |
| 5,355,699 | 10/1994 | Inagaki et al. | 66/60 R X |

FOREIGN PATENT DOCUMENTS

| | | |
|---|---|---|
| 0238797 | 1/1987 | European Pat. Off. . |
| 0435690 | 12/1990 | European Pat. Off. . |
| 0567282 | 4/1993 | European Pat. Off. . |
| 6-10247 | 6/1994 | Japan . |

*Primary Examiner*—John J. Calvert

*Attorney, Agent, or Firm*—Webb Ziesenheim; Bruening Logsdon; Orkin & Hanson, P.C.

[57] ABSTRACT

The sinker actuating apparatus has a sinker actuator which is displaced on a needle bed so as to move a movable sinker to a pressing or releasing position. A connector for connecting the actuator is non-fixedly provided to a needle moving device so that the actuator is moved in response to the movement of the needle mover. First and second stopper are provided for restricting the advanced or retracted positions of the sinker actuator. A resilient member is arranged to give an advancing force to the actuator.

7 Claims, 12 Drawing Sheets

SINKER ACTUATING APPARATUS HAVING SPRING FORCE ADVANCING MEMBER

BACKGROUND OF THE INVENTION

1. Field of the Invention

This invention relates to a sinker actuating apparatus for a flat-knitting machine, and more particularly, to an apparatus for moving a sinker disposed on a needle bed back and forth in response to movement of a knitting needle.

2. Description of the Related Art

A flat knitting machine of the type wherein each of knitting needles is moved back and forth by an actuator such as a linear motor includes a plurality of movable sinkers which prevent needle loops from riding up together with tile knitting needles upon back and forth movement of the knitting needles, particularly from riding up upon forward movement of the knitting needles. Each of the sinkers is moved by an actuating apparatus in response to back and forth movement of a corresponding one of the knitting needles between a pressing position for pressing a knitted fabric and a releasing position for releasing the knitted fabric. It is to be noted that, in the present invention, a movement of a knitting needle in a direction to be projected from the position of a knitted fabric is referred to as forward movement or advancement, and a movement of the knitting needle in the opposite direction to be retracted from its projecting position toward the knitted fabric is referred to as backward movement or retraction.

One of movable sinker actuating apparatuses of the type described above is disclosed, for example, in Japanese Patent Appln. Public Disclosure No. 5-10247 which includes sinker actuating means disposed so as to move forward and backward on a needle bed Lo displace sinkers between a pressing position and a releasing position, connecting means for disconnectably or non-fixedly connecting the sinker actuating means to needle moving means provided for moving knitting needles back and forth, to move the sinker actuating means in response to movement of the needle moving means, and a forward positioning stopper and a backward positioning stopper for restricting an advanced position and a retracted position of each of the sinker actuating means, respectively.

According to the actuating apparatus described above, however, since each of the sinkers is merely displaced to tile pressing position upon forward movement of the corresponding knitting needle, a knitted fabric is not pressed by the sinker when a needle loop is to be formed or when the knitting needle is at a position a little advanced after formation of a needle loop, that is, when the knitting needle is retracted to a standby position. As a result, upon formation of a needle loop of a particular loop size, the needle loop cannot knock over, or during a standby condition of the knitting needle, a loop formed at the previous time, that is, an old loop, may ride up, resulting in formation of a swollen portion of the knitted fabric. The frequency of such phenomenon increases as the knitting pattern becomes complicated such as when a fabric of a pattern having great ups and downs is to be knitted or when knitting is performed locally.

SUMMARY OF THE INVENTION

It is an object of the present invention to have a sinker displaced at a pressing position also upon formation of a needle loop and during standby of a knitting needle.

The sinker actuating apparatus according to the present invention can be applied to a knitting machine which includes a plurality of knitting needles disposed on a needle bed so as to move forward and backward, a plurality of movable sinkers disposed on the needle bed so as to displace between a pressing position for pressing a knitted fabric and a releasing position for releasing the knitted fabric, and needle moving means for reciprocating the knitting needles.

The sinker actuating apparatus comprises, for each of the sinkers, sinker actuating means disposed on tile needle bed so as to move forward and backward to displace the sinker between the pressing position and the releasing position, connecting means for non-fixedly connecting the sinker actuating means to a corresponding one of the needle moving means to move the sinker actuating means in response to the movement of the needle moving means, stopper means having a first stopper portion and a second stopper portion for restricting an advanced position and a retracted position of the sinker actuating means, and a resilient member provided for giving an advancing force to the sinker actuating means.

The second stopper portion of the stopper is formed at a position at which the second stopper portion stops the retracting movement of the sinker actuating means when the corresponding knitting needle is moved backward by a suitable distance from its most advanced position thereof. The connecting means disconnects the sinker actuating means from the needle moving means before the corresponding knitting needle is retracted to a position at which the knitting needle forms a needle loop after the sinker actuating means is abutted with the second stopper portion of the stopper. The resilient member has a spring force lower than a connecting force between the sinker actuating means and the needle moving means by the connecting means.

In the sinker actuating apparatus, when the knitting needle approaches its most retracted position, the connecting means releases the sinker actuating means from the needle moving means, and the sinker actuating means is advanced by the spring force of the resilient member and holds a corresponding movable sinker at the pressing position. Consequently, upon formation of a needle loop and at, the standby position of the knitting needle, the knitted fabric is pressed by the sinker, and a loop at the previous time, that is, an old loop, is kept prevented from riding up or the like.

When the knitting needle is advanced, the sinker actuating means holds the sinker at the pressing position under an advancing force of the needle moving means and the spring force of the resilient member. Consequently, the knitted fabric is pressed by the sinker, and the old loop is prevented from riding up.

When the knitting needle is retracted, the sinker is held at the releasing position until the connecting means releases the sinker actuating means from the needle moving means after the sinker actuating means is abutted with the second stopper portion of the stopper, and thereafter the sinker releases the knitted fabric. However, after the connecting means releases the sinker actuating means from the needle moving means, the sinker is returned to and thereafter held at the holding down position by the spring force of the resilient member. Consequently, the knitted fabric is pressed by the sinker, and the old loop is prevented from riding up or the like.

According to the sinker actuating apparatus of the present invention, also upon formation of a needle loop and during standby of the knitting needle, the sinker is displaced to the pressing position for pressing the knitted fabric. Consequently, otherwise possible incomplete knocking over upon formation of a needle loop or dropping of a stitch upon standby of the knitting needle can be prevented.

The advantage of the sinker actuating apparatus of the present invention described above is achieved by the construction that an advancing force is given to the sinker actuating means by the resilient member which has a spring force lower than the connecting force between the sinker actuating means and the needle moving means by the connecting means, and that the second stopper portion is formed at the position to stop the backward movement of the sinker actuating means when the knitting needle is retracted by a certain distance from the most advanced position such that the needle moving means and the sinker actuating means by the connecting means are disconnected from each other while the knitting needle is retracted from the position at which the sinker actuating means abuts on the second stopper portion to the position at which the knitting needle forms a new loop.

The first stopper portion of the stopper means may be formed at a position at which the sinker actuating means displaces the sinker to the pressing position while the sinker actuating means is in abutting engagement with the first stopper portion.

In some preferred embodiments, the connecting means includes first and second engaging members disposed for mechanical friction engagement with each other, and one of the first and second engaging members is connected to the sinker actuating means while the other of the first and second engaging means is connected to the corresponding needle moving means.

In another preferred form, the connecting means includes first and second d engaging members for magnetic engagement with each other, and one of the first and second engaging members is connected to the corresponding needle moving means while the other of the first and second engaging members is connected to the sinker actuating means.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
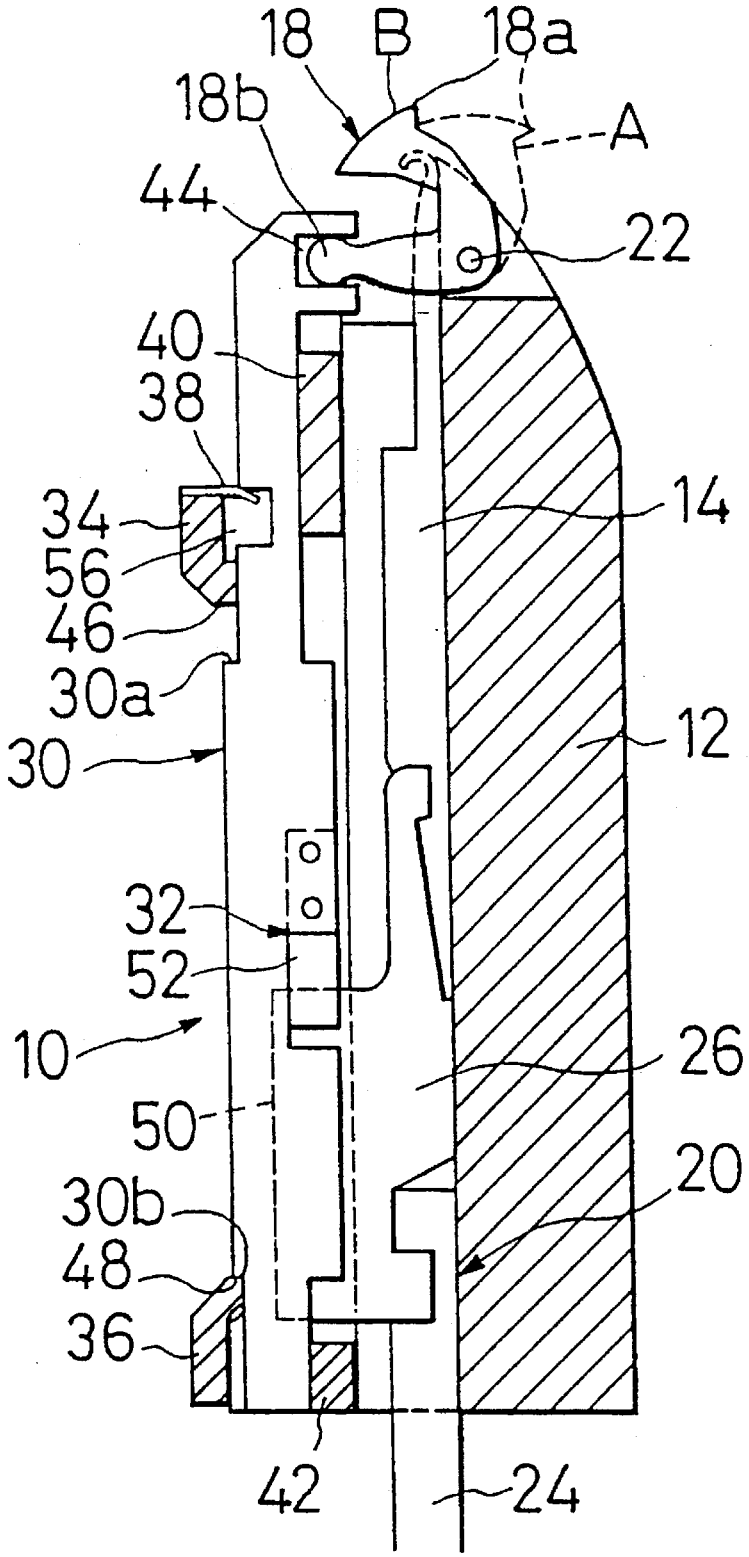
FIG. 1 is a sectional view of a flat-knitting machine in which a sinker actuating apparatus of the present invention is disposed on a needle bed and shows a preferred embodiment of the present invention.
Figure 2:
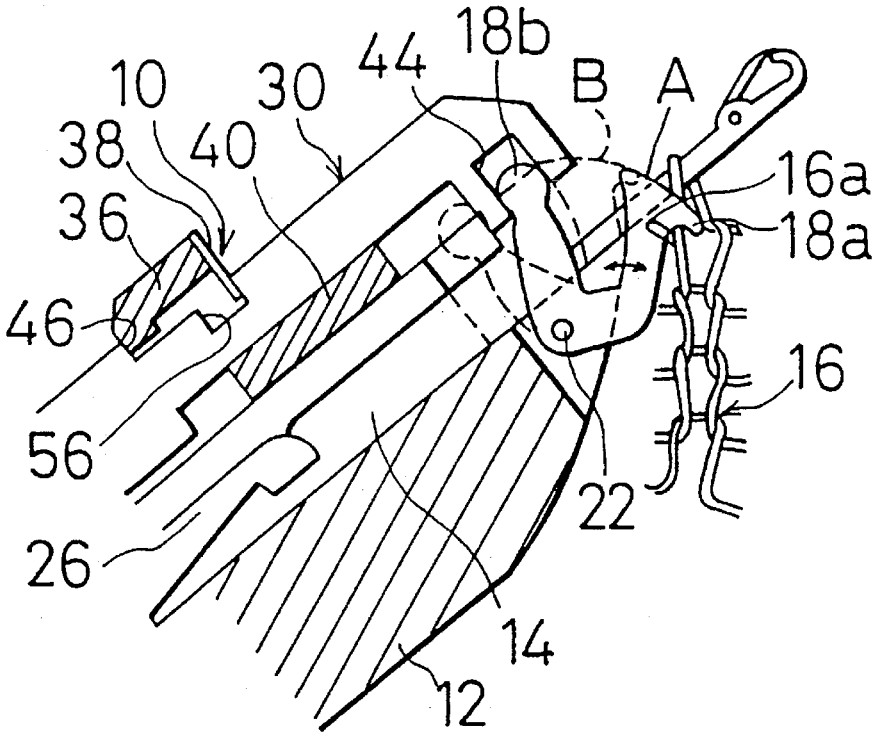
FIG. 2 is a sectional view showing a part of a movable sinker of the sinker actuating apparatus shown in FIG. 1.
Figures 3A, 3B:
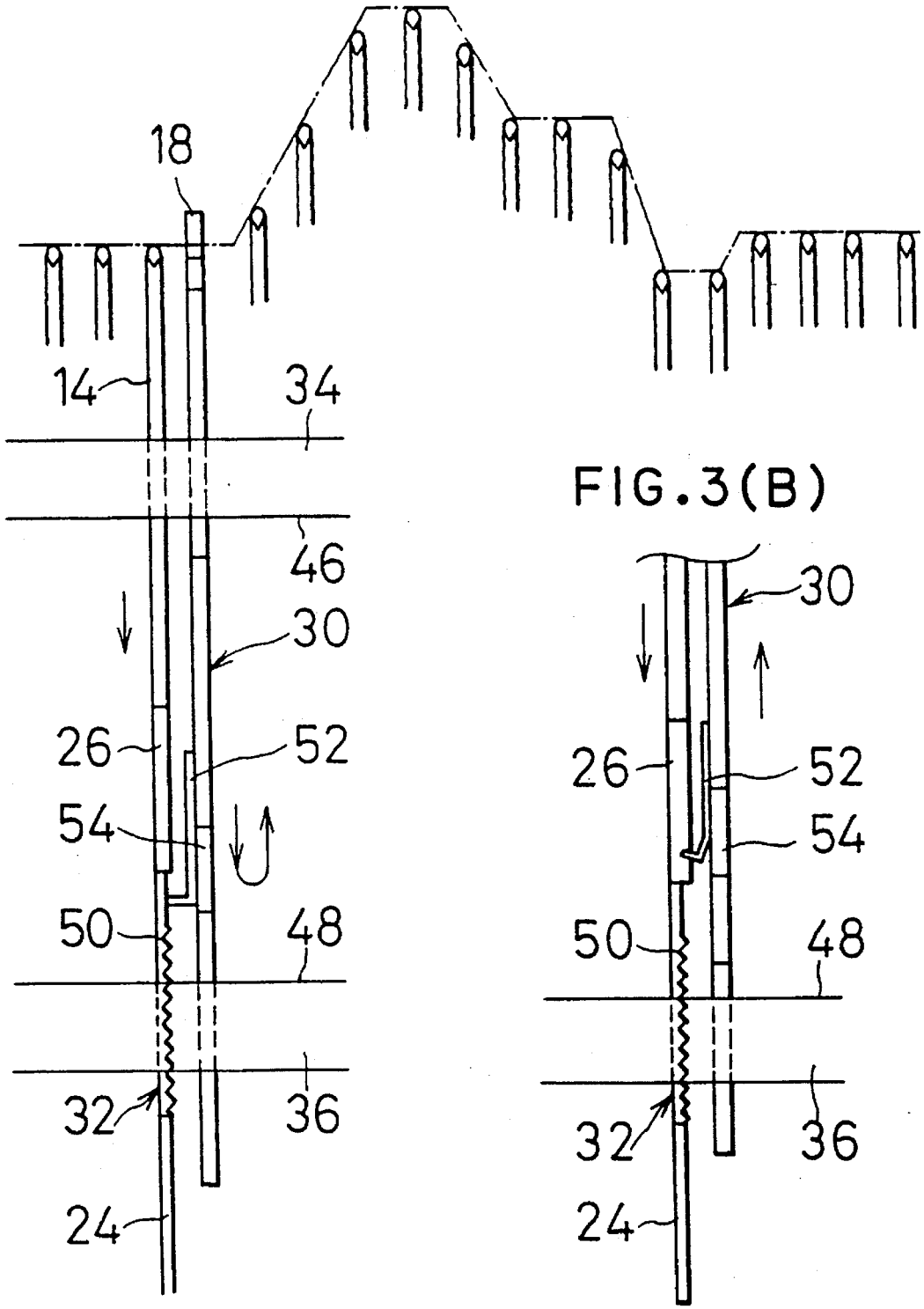
FIGS. 3 (A) and 3 (B) are schematic views illustrating operation of the actuating apparatus shown in FIG. 1 and wherein FIG. 3 (A) illustrates the movement of a knitting needle and simultaneously shows a left side elevation of the actuating apparatus when the knitting needle is at its standby position, and FIG. 3 (B) shows a left, side elevation of a connecting mechanism of the actuating apparatus when the knitting needle is at its most advanced position.

Referring to FIGS. 1 to 3, a sinker actuating apparatus 10 is applied and incorporated in a fiat-knitting machine which includes a plurality of knitting needles 14 disposed on a needle bed 12 so as to move forward and backward, a plurality of movable sinkers 18 disposed on the needle bed 12 so as to displace between a first position, i.e. pressing position A for pressing a knitted fabric 16 and a second position, i.e. releasing position B for releasing the knitted fabric 16, and a plurality of needle moving mechanisms 20 serving as needle moving means for individually reciprocating the knitting needles 14.

While the single needle bed 12 is shown in FIGS. 1 to 3, actually the flat-knitting machine includes a pair of such needle beds 12 disposed at an interval in an inverted V-shaped configuration such that a needle loop forming area of the flat knitting machine may be formed therebetween. Each of the needle bed 12 extends in a cross direction of the knitted fabric 16, that is, in a direction perpendicular to the plane of FIGS. 1 and 2. It is to be noted, however, that the present invention can be also applied to a flat-knitting machine which includes a single needle bed.

the needle beds 12 are supported on a frame of the flat-knitting machine for individual movement in their longitudinal direction, that is, in a direction perpendicular to the plane of FIGS. 1 and 2 and are moved in the longitudinal direction relative to each other and relative to the frame each by means of a needle bed actuating mechanism not shown. The knitting needles 14, the sinkers 18 and the needle moving mechanisms 20 are disposed on the same one of the needle beds 12 in a one-to-one corresponding relationship to each other.

The knitting needles 14 are successively disposed on each of the needle beds 12 in the longitudinal direction of the needle bed 12 so as to extend in the cross direction of the needle bed 12. Each of the knitting needles 14 is reciprocated in its longitudinal direction in a predetermined needle movement pattern by way of a corresponding one of the needle moving mechanisms 20 having an actuator such as a linear motor provided for each knitting needle.

Figure 4:
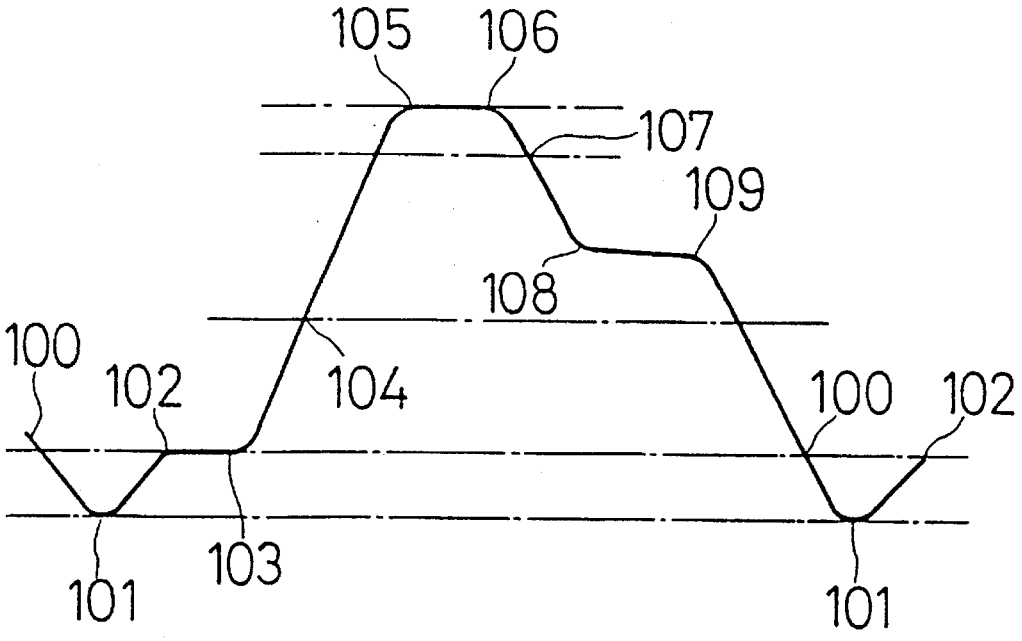
FIG. 4 is a diagrammatic view showing an example of a pattern of movement of a knitting needle.

The needle movement pattern is represented as a chart similar to a chart called cam pattern or cam chart employed for a flat knitting machine of the cam type wherein the knitting needle is reciprocated by a cam mechanism. In particular, the needle movement pattern is represented as a chart wherein the amount of movement of a knitting needle is represented as the axis of ordinate, and herein the time, the amount of a yarn carrier, a combination of them or the like are represented as the axis of abscissa. An example of such a needle movement pattern is shown in FIG. 4.

Each of the sinkers 18 is formed in a generally U-shape from a pressing portion 18*a* for pressing the knitted fabric 16 and a fitting portion 18*b* to be fitted in the actuating apparatus 10. The sinker 18 is supported for pivotal motion on the needle bed 12 by means of a pivot pin 22 which extends in the cross direction of the knitted fabric 16. The sinker 18 displaced at the pressing position A is indicated by a broken line in FIG. 1 but by a solid line in FIG. 2, and the sinker 18 displaced at the releasing position B is indicated by a solid line in FIG. 1 but by a broken line in FIG. 2.

Each of the needle moving mechanisms 20 includes a moving member 24 in the form of an elongated plate which is reciprocated in the longitudinal direction of the associated knitting needle 14 by an actuator such as a linear motor, and a connecting jack 26 for connecting the moving member 24 and the knitting needle 14 to each other. Such moving member 24 and connecting jack 26 are disposed on the needle bed 12 so as to move reciprocally in the direction of movement of the knitting needle 14.

The actuating apparatus 10 includes, for each of the sinkers 18, an elongated sinker actuating member 30 disposed on the needle bed 12 so as to move reciprocally to selectively displace the sinker 18 to one of the pressing position A and the releasing position B, a connecting mechanism 32 for disconnectably or non-fixedly connecting the sinker actuating member 30 to the corresponding needle moving mechanism 20 so as to move the sinker actuating member 30 in response to the movement of the needle moving mechanism 20, a forward positioning stopper, i.e. first stopper 34 for restricting an advanced position of the sinker actuating member 30, a backward positioning stopper, i.e. second stopper 36 for restricting a retracted position of the sinker actuating member 30, and a resilient member 38 for providing an advancing force to the sinker actuating member 30.

The sinker actuating member 30 is disposed on the needle bed 12 so as to reciprocate in its longitudinal direction under the guidance of a pair of upper and lower guides 40 and 42 disposed on the needle bed 12, and has, at an end thereof, a recess 44 in which the fitting portion 18*b* of the sinker 18 is fitted. The sinker actuating member 30 is abutted, when it is advanced to a predetermined position, at an abutting portion 30*a* thereof on a forward positioning stopper portion, i.e. first stopper portion 46 of the first stopper 34, while it is abutted, when retracted to another predetermined position, at another abutting portion 30*b* thereof on a backward positioning stopper portion, i.e. second stopper portion 48 of the second stopper 36.

The connecting mechanism 32 includes, in the embodiment shown, a first engaging member 50 in the form of an elongated rack and a second engaging member 52 bent in an L-shape. The first engaging member 50 has a plurality of mountain-shaped portions formed on the connecting jack 26 at intervals from each other in the longitudinal direction of the connecting jack 26 so as to extend in a cross direction of the connecting jack 26. The second engaging member 52 is formed from an L-shaped leaf spring having first and second pieces extending substantially perpendicularly to each other. The second engaging member 52 is secured at the second piece thereof to the sinker actuating member 30 by suitable means such as a screw, a rivet or welding such that the first piece thereof may be releasably engaged with an engaging portion of the first engaging member 50.

As shown in FIG. 3 (B), the second engaging member 52 is shaped to have a strong spring force so as to connect the connecting jack 26 and the sinker actuating member 30 to each other with a predetermined connecting force. The sinker actuating member 30 has a notched portion 54 which can receive a portion of the second engaging member 52 by elastic deformation of the second engaging member 52. Consequently, when a slip occurs between the first and second engaging members 50 and 52, each time the first piece of the second engaging member 52 rides over the engaging portion of the first engaging member 50, the portion of the second engaging member 52 is admitted into or discharged from the notched portion 54

The stoppers 34 and 36 are supported on the needle bed 12. The resilient member 38 is formed as a leaf spring mounted on the first stopper 34. The resilient member 38 is normally received in a notched portion 56 formed on the sinker actuating member 30, and normally exerts an advancing force to the sinker actuating member 30. The spring force of the resilient member 38 is lower than the mechanical connecting force between the sinker actuating member 30 and the needle moving mechanism 20 by the connecting mechanism 32, that is, the frictional engaging force between the first and second engaging members 50 and 52 of the connecting mechanism The first stopper 34 is located at a position where the sinker actuating member 30 holds the sinker 18 at the pressing position A when the sinker actuating member 30 is abutted on the first stopper 34. In the meantime, the second stopper 36 is located at another position where it stops retracting movement of the sinker actuating member 30 when the knitting needle 14 is retracted to a position spaced apart by a predetermined distance from its most advanced position 105 or 106 in FIG. 4, for example, to a position 107 in FIG. 4.

The first stopper 34 is located more particularly at a position where the connecting mechanism 32 connects the sinker actuating member 30 to the needle moving mechanism 20 when the knitting needle 14 is advanced to a position spaced apart by a certain distance from a standby position 102 or 103 in FIG. 4, for example, to a position 104.

The connecting mechanism 32 disconnects the sinker actuating member 30 from the needle moving mechanism 20, that is, the connection of the first and second engaging members 50 and 52 is released when the knitting needle 14 is retracted to a suitable position between one retracted position where it forms a needle loop and another retracted position where the sinker actuating member 30 is abutted on the second stopper 36, for example, to a position 100 shown in FIG. 4.

Figure 7:
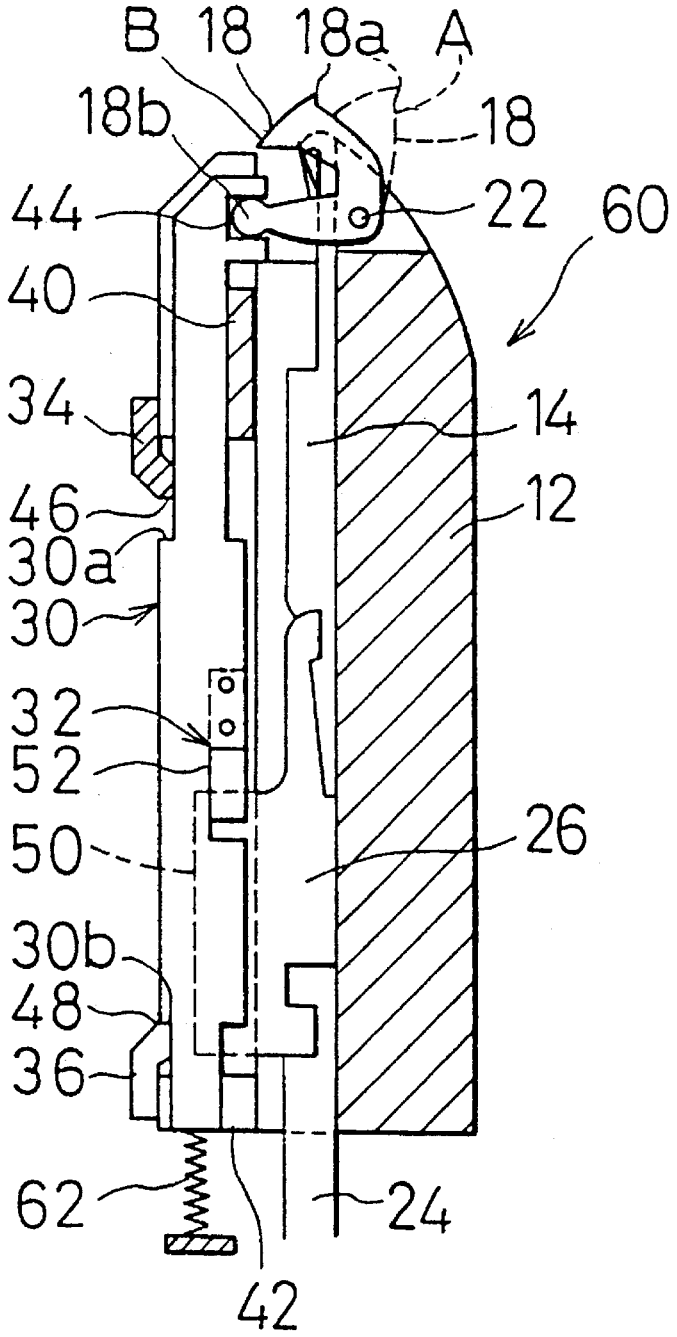
FIG. 7 is a sectional view showing an actuating apparatus according to another preferred embodiment of the present invention.

The resilient member for exerting a force to the sinker actuating member 30 to advance the sinker actuating member 30 relative to the needle moving mechanism 20 may be a compression coil spring disposed between the sinker actuating member 30 and another member, or a compression coil spring 62 disposed at the rear end portion of the sinker actuating member 30 in such a manner as in an actuating apparatus 60 shown in FIG. 7, or may alternatively be a tension coil spring disposed between the sinker actuating member 30 and another member.

Operation of the actuating apparatus 10 will be described subsequently with reference to FIGS. 4, 5 (A) to 5 (E) and 6 (A) to 6 (E) . In FIGS. 5 (A) to 5 (E) and 6(A) to 6 (E) , a spring force of the resilient member 38 of 62 is denoted by reference numeral 64.

Figures 5A, 5B, 5C, 5D, 5E:
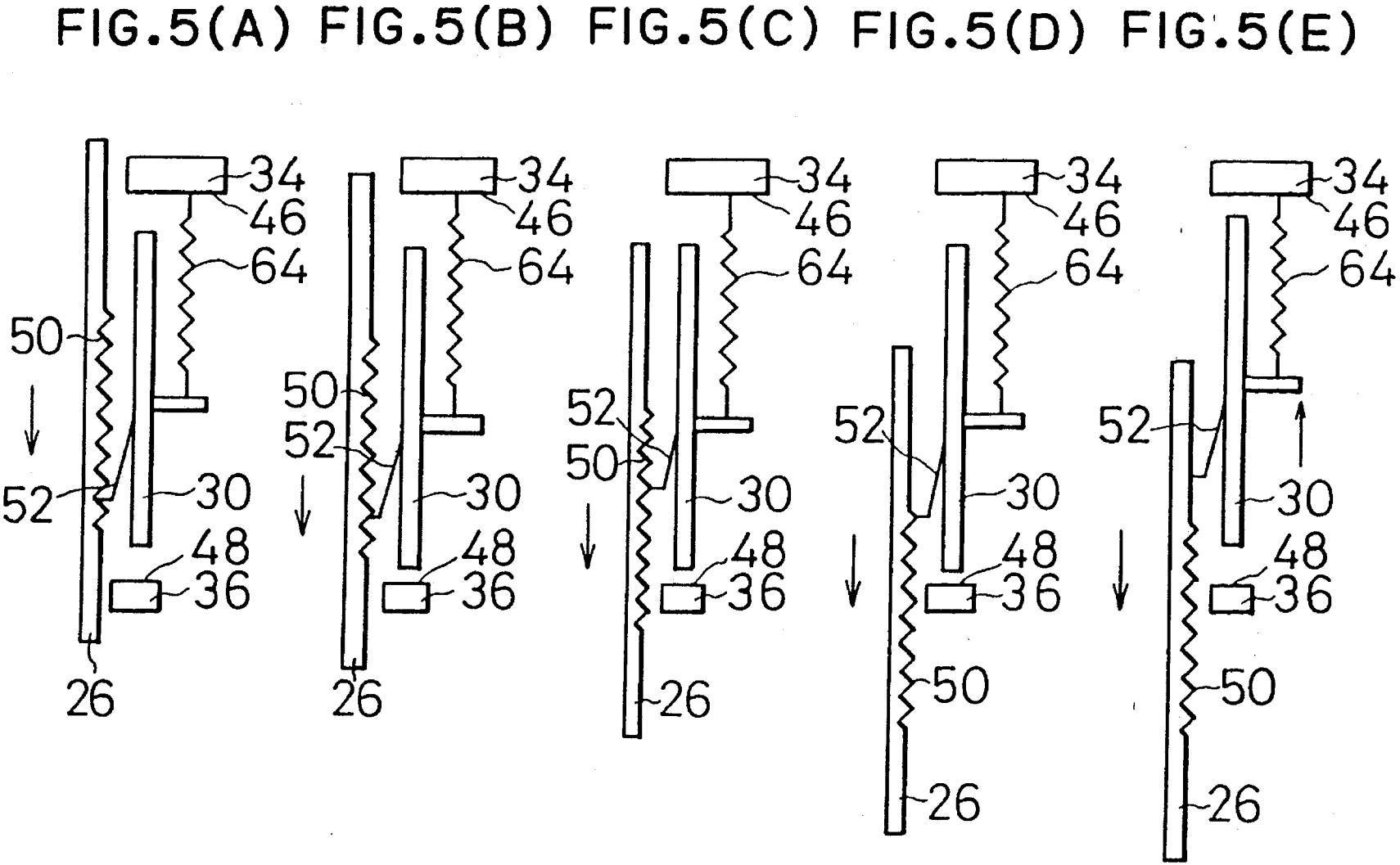
FIGS. 5 (A) to 5(E) are schematic views illustrating the operation of the actuating apparatus shown in FIG. 1 and another actuating apparatus shown in FIG. 7 when a knitting needle is moved forward.

As shown in FIG. 5(A), when the knitting needle 14 is positioned between the position 100 and a most retracted position 101 for formation of a new needle loop shown in PIG. 4, the first and second frictional engaging members 50 and 52 of the connecting mechanism 32 are under disengagement from each other, and the sinker actuating member 30 is released from the needle moving mechanism 20. Consequently, the sinker actuating member 30 is abutted at the abutting portion 30*a* thereof on the first stopper portion 46 under the spring force 64 of the resilient member 38 or 62 while the sinker 18 is displaced to the pressing position A. Consequently, the knitted fabric 16 is pressed by the sinker 18, and is held in a condition wherein an old loop 16*a* (refer to FIG. 2) is prevented from riding up or the like.

As shown in FIG. 5(B), when the knitting needle 14 is advanced from the most retracted position 101 to the position 104 past the standby positions 102 and 103 shown in FIG. 4, the connecting jack 26 of the needle moving mechanism 20 is advanced. However, engagement between the first and second engaging members 50 and 52 does not occur, the sinker actuating member 30 is abutted at the portion 30*a* on the first stopper portion 46 under the spring force 64, and the sinker 18 is held at the first position A.

As shown in FIG. 5(C), when the knitting needle 14 is advanced to the position 104 shown in FIG. 4, the first and second engaging members 50 and 52 are engaged with each other. Consequently, the sinker actuating member 30 is connected to the needle moving mechanism 20 by way of the first and second engaging members 50 and 52 and receives the advancing force of the needle moving mechanism 20. However, since the sinker actuating member 30 has already been abutted on the first stopper portion 46, the sinker 18 is kept at the first position A.

As shown in FIG. 5(D), when the knitting needle 14 is moved from the position 104 to the most advanced position 105 in FIG. 4, the sinker actuating member 30 remains abutted on the first stopper portion 46. Thus, when the knitting needle 14 is advanced, an overload exceeding the connecting force or coupling force between the first and second engaging members 50 and 52 acts between the first and second engaging members 50 and 52.

Consequently, a slip occurs between the first and second engaging members 50 and 52, and although the needle moving mechanism 20 and the knitting needle 14 advance, the sinker actuating member 30 stops its advancing movement. However, since the sinker actuating member 30 receives an advancing force arising from the slip between the first and second engaging members 50 and 52, it is held abutted on the first stopper portion 46, and the sinker 18 is kept at the first position A.

Such slip between the first and second engaging members 50 and 52 occurs also when an excessive load exceeding the connecting force between the first and second engaging members 50 and 52, caused when the sinker 18presses the knitted fabric 16, acts between the first and second engaging members 50 and 52. The slip allows the sinker actuating member 30 to hold the sinker 18 at the pressing position A while the needle moving mechanism 20 and the knitting needle 14 advance.

As shown in FIG. 5 (E), since the first and second engaging members 50 and 52 remain in engagement with each other also while the knitting needle 14 stays at its most advanced position 105 or 106 shown in FIG. 4, the sinker actuating member 30 remains abutted on the stopper portion 46, and the sinker 18 is held at the pressing position A.

Figures 6A, 6B, 6C, 6D, 6E:
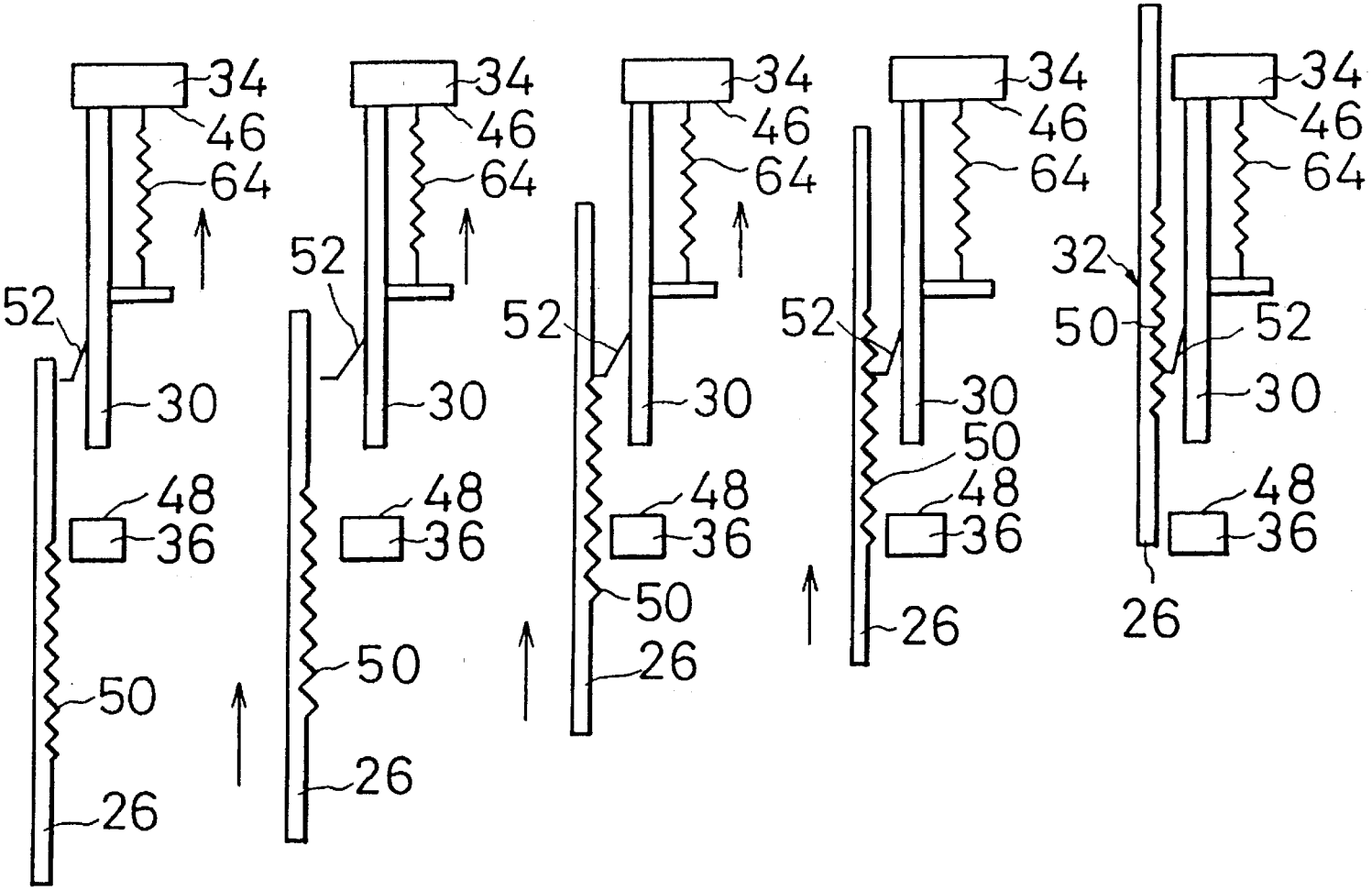
FIGS. 6 (A) to 5(E) are similar views but illustrating operation of the actuating apparatus shown in FIGS. 1 and 7 when the knitting needle is moved backward.

As shown in FIG. 6(A), while the knitting needle 14 is subsequently retracted from the most advanced position 105 to the position 107 shown in FIG. 4, since the sinker actuating member 30 is held in connection to the needle moving mechanism 20 by the first and second engaging members 50 and 52, the sinker actuating member 30 is retracted together with the knitting needle 14 against the spring force 64 and the sinker 18 is displaced toward the releasing position B of FIG. 2.

As shown in FIG. 6 (B), when the knitting needle 14 is retracted to the position 107 shown in FIG. 4, the abutting portion 30*b* of the sinker actuating member 30 is abutted on the second stopper portion 48 and the sinker 18 is displaced to the releasing position B. Consequently, the knitted fabric 16 is released from the sinker 18.

As shown in FIG. 6(C), while the knitting needle 14 is subsequently moved from the position 107 to the position 100 past positions 108 and 109 shown in FIG. 4, the sinker actuating member 30 remains in abutting engagement with the second stopper portion 48. Thus, an excessive load exceeding the engaging force or coupling force between the first and second engaging members 50 and 52 acts on the first and second engaging members 50 and 52, while the knitting needle 14 is retracted from the position 107 to the position 100. Consequently, a slip occurs between the first and second engaging members 50 and 52, and as a result, although the needle moving mechanism 20 and the knitting needle 14 are retracted, the sinker actuating member 30 stops its retracting movement. However, since the sinker actuating member 30 receives a retracting force arising from the slip between the first and second engaging members 50 and 52, it is held in a condition abutting on the second stopper portion 48 and keeps the sinker 18 at the releasing position B.

As shown in FIG. 6 (D), when the knitting needle 14 is retracted to the position 100 shown in FIG. 4, the first and second engaging members 50 and 52 are disengaged from each other, and the sinker actuating member 30 is released from the needle moving mechanism 20 by the connecting mechanism 32 so that the retracting force of the needle moving mechanism 20 no more acts on the sinker actuating member 30. Consequently, as shown in FIG. 6 (E), the sinker actuating member 30 is moved by the advancing force provided by the spring force 64, and abuts on the first stopper portion 46, so that the sinker 18 is kept at the pressing position A. As a result, the knitted fabric 16 is pressed by the sinker 18, and is kept in a condition where the old loop 16*a* is prevented from riding up.

Thereafter, the knitting needle 14 is retracted to the most retracted position 101 shown in FIG. 4, and then advanced to the standby position 102 shown in FIG. 4. During the movement of the knitting needle 14, the sinker actuating member 30 keeps the sinker 18 at the pressing position A with the spring force 54.

Referring now to FIGS. 8 (A) and 8(B), a connecting mechanism 72 of a sinker actuating apparatus 70 includes a first engaging member 74 pivotally supported on the needle bed 12, and a second engaging member 76 attached to the connecting jack 26.

The first engaging member 74 is formed in a V-shape from an engaging portion 74*a* having an end portion for being frictionally engaged with the second engaging member 76, and a fitting portion 74*b* having an end portion fitted in a recess 78 formed at a lower end of the sinker actuating member 30. The first engaging member 74 is supported, at a connecting portion thereof between the engaging portion 74*a* and the fitting portion 74*b*, so as to move pivotally on the needle bed 12 by means of a pin 80.

The second engaging member 76 is formed from a leaf spring having a base portion 76*a* attached to the connecting jack 26, a concave portion 76*b* contiguous to an end of the base portion 76*a*, a flat portion 76*c* contiguous to the concave portion 76*b*, and an inclined portion 76*d* contiguous to the flat portion 76*c*.

The needle bed 12 has a guide portion 82 for abutting engagement with the second engaging member 76. The second engaging member 76 is disposed in a recess 84 between the guide portion 82 and a main portion of the needle bed 12. The connecting jack 26 is connected to an elongated slider 88 which extends in the forward and backward direction through a lower guide 86 of the needle bed 12.

The sinker actuating member 30 extends through an upper guide and stopper 94 of the needle bed 12. The stopper 94 has a first stopper portion 46 for being abutted by the abutting portion 30*a* on the lower end side of the sinker actuating member 30 to restrict the advanced position of the sinker actuating member 30, and a second stopper portion 48 for being abutted by the abutting portion 30*b* on the upper end side of the sinker actuating member 30 to restrict the retracted position of the sinker actuating member 30. A resilient member 92 is connected to the sinker actuating member 30 and the stopper 94.

Figure 8A:
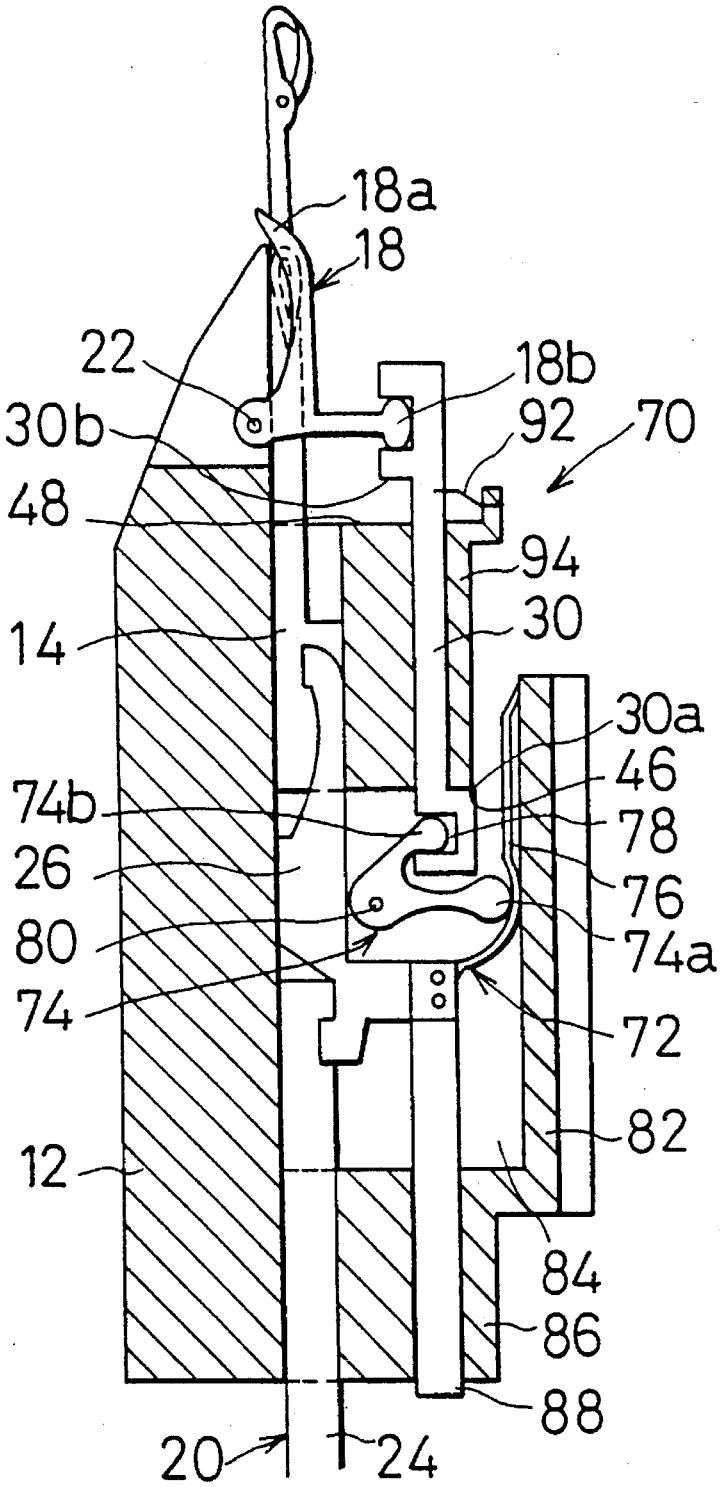
FIG. 8(A) is a sectional view showing an actuating apparatus according to a further preferred embodiment of the present invention.
Figure 8B:
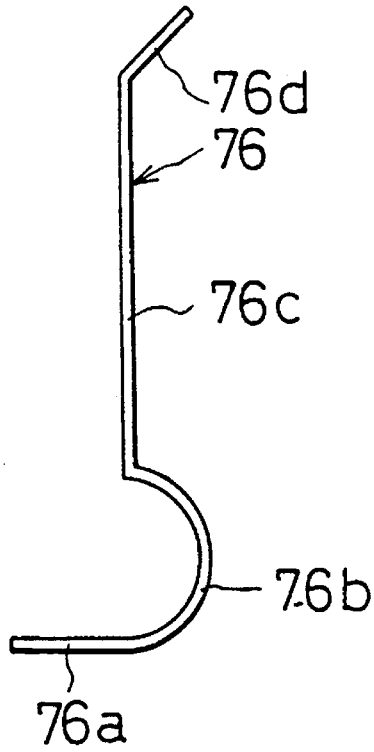
FIG. 8(B) is an enlarged view of an engaging member of the actuating apparatus of FIG. 8 (A)
Figure 9:
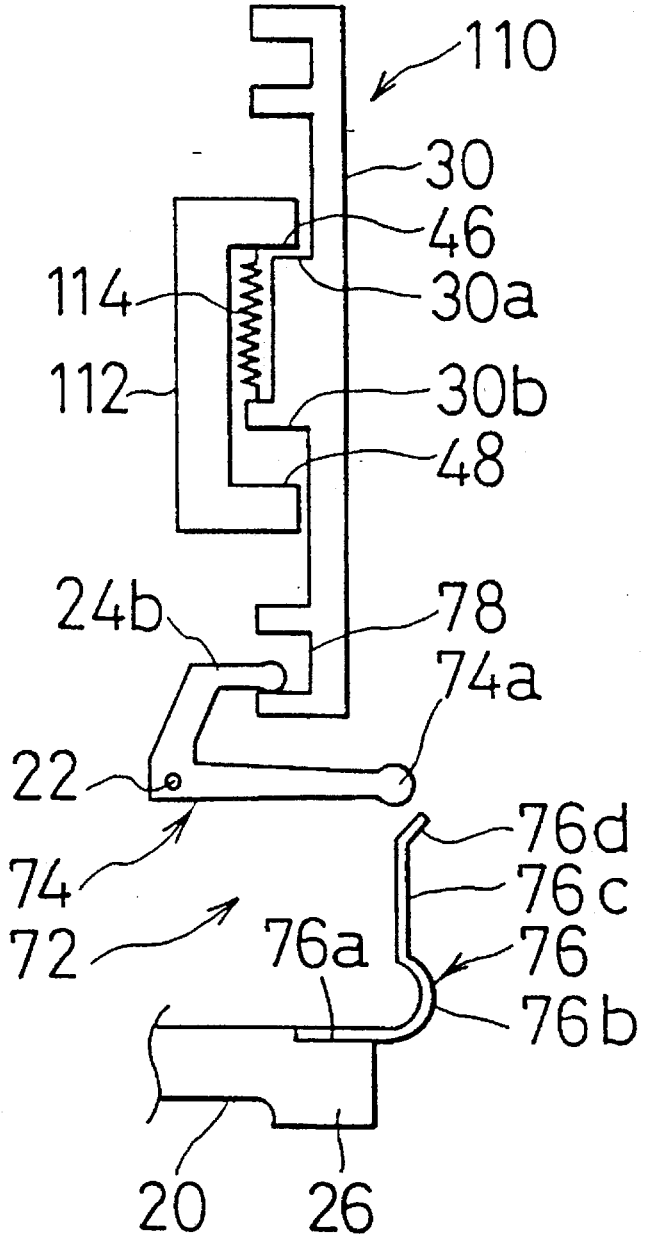
FIG. 9 is a schematic view showing an actuating apparatus according to a still further preferred embodiment or the present invention.

In the sinker actuating apparatus 70 shown in FIGS. 8 (A) and 8 (B), such a tension coil spring disposed between the sinker actuating member 30 and a stopper 112 as in a sinker actuating apparatus 110 shown in FIG. 9 may be used as a resilient member 114 which exerts a force to the sinker actuating member 30 to advance the sinker actuating member 30 relative to the needle moving mechanism 20.

In the embodiment shown in FIG. 9, he advanced position of the sinker actuating member 30 is restricted by the abutting portion 30*a* abutted on the first stopper portion 46 of the stopper 112, and the retracted position of the sinker actuating member 30 is restricted by the abutting portion 30*b* abutted on the second stopper portion 48 of the stopper 112.

The sinker actuating apparatus 70, 110 of the embodiment shown in FIGS. 8(A) and 8(B) and the embodiment shown in FIG. 9 operate in a substantially similar manner. Therefore, operation of the sinker actuating apparatus 110 of the embodiment shown in FIG. 9 will be described below with reference to FIGS. 4, 10(A) to 10(C)and 11(A) to 11(D).

Figure 10C:
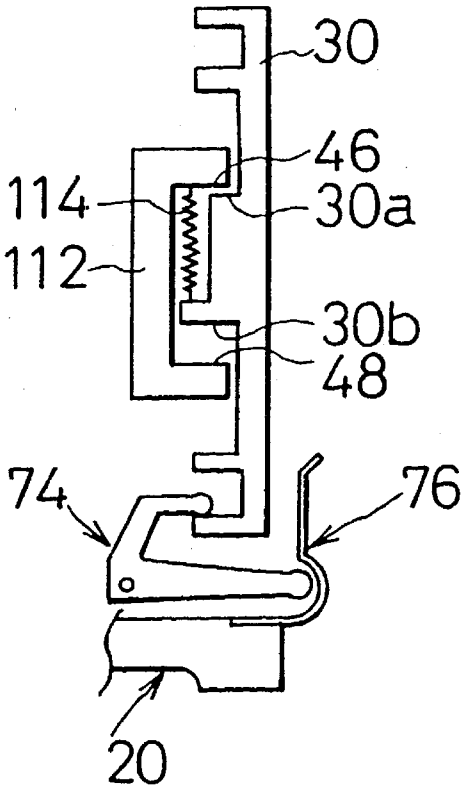
FIGS. 10(A) to 10 (C) are schematic views illustrating the operation of the actuating apparatus of FIG. 9 when a knitting needle is moved forward.
Figure 10B:
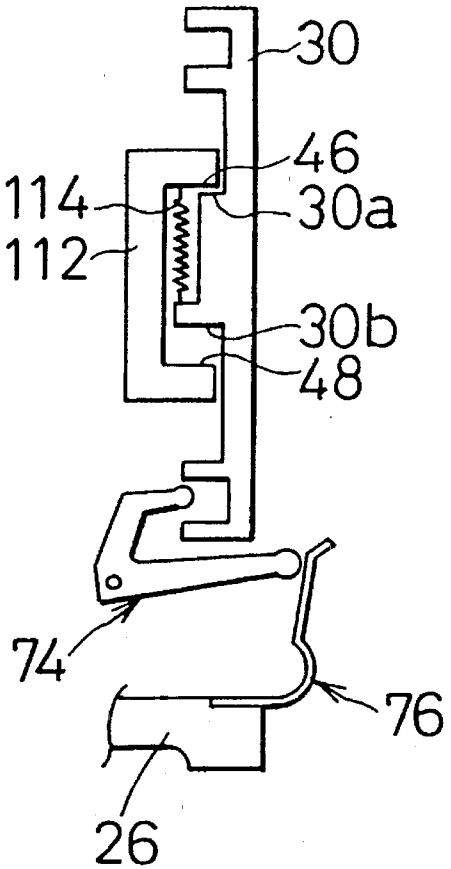
Figure 10A:
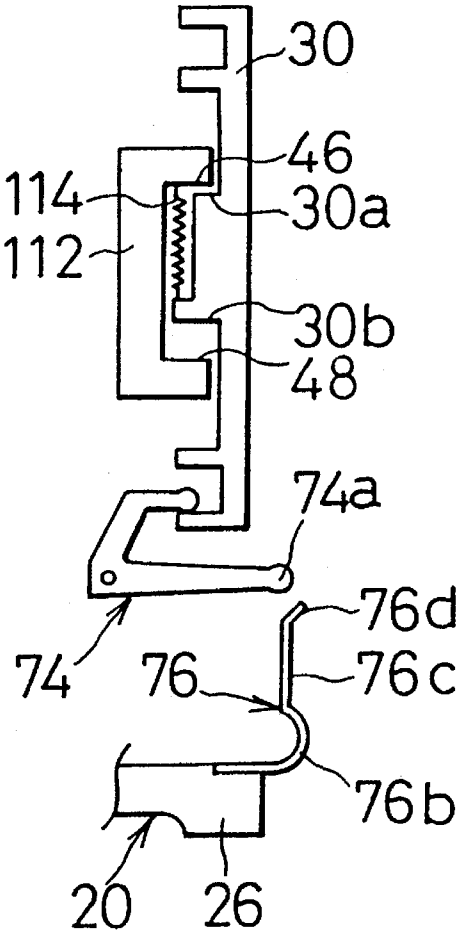

As shown in FIG. 10(A), when the knitting needle 14 is retracted to the most retracted position 101 for formation of a needle loop shown in FIG. 4, the second engaging member 76 is spaced downward by a great distance from the first engaging member 74, and the sinker actuating member 30 is disconnected from the needle moving mechanism 20. Therefore, the abutting portion 30*a* of the sinker actuating member 30 is abutted on the first stopper portion 46 under the spring force of the resilient member 114, and the sinker 18 is held at the pressing position A where it presses a knitted fabric.

Also, while the knitting needle 14 is moved from the most retracted position 101 to the standby position 102 shown in FIG. 4, while the knitting needle 14 stays at the position 102 or 103 in FIG. 4, and while the knitting needle 14 is moved from the position 103 to the position 104, the first and second engaging members 74 and 76 are disengaged from each other, and the sinker actuating member 30 is abutted on the first stopper portion 46 under the spring force of the resilient member 114.

As shown in FIG. 10(B), when the knitting needle 14 is advanced to the position 104 shown in FIG. 4, the inclined portion 76*d* of the second engaging member 76 is abutted on the engaging portion 74*a* of the first engaging member 74. Consequently, the sinker actuating member 30 is connected to the needle moving mechanism 20 by way of the first and second engaging members 74 and 76, and is acted upon by an advancing force of the needle moving mechanism 20. However, since the sinker actuating member 30 is already abutted on the first stopper portion 46, the sinker 18 is kept at the pressing position A.

When the knitting needle 14 is advanced further from the position 104 shown in FIG. 4, the flat portion 76*c* of the second engaging member 76 is engaged with the engaging portion 74*a* of the first engaging member 74 so that it is thereafter acted upon by an advancing force of the needle moving mechanism 20. However, since the sinker actuating member 30 is abutted on the first stopper portion 46, a slip occurs between the engaging portion 74*a* of the first engaging member 74 and the flat portion 76*c* of the second engaging member 76, and consequently, the sinker actuating member 30 keeps the sinker 18 at the pressing position A.

As shown in FIG. 10(C), when the knitting needle 14 is advanced further to the most advanced position 105 shown in FIG. 4, the concave portion 76*b* of the second engaging member 76 receives the engaging portion 74*a* of the first engaging member 74, and consequently, the sinker actuating member 30 is released from the needle moving mechanism 20, and is thereafter acted upon only by the advancing force of the resilient member 114. Consequently, the sinker actuating member 30 is abutted on the first stopper portion 46 under the advancing force of the resilient member 114, and the sinker 18 is held at the pressing position A.

Also, while the knitting needle 14 stays at the most advanced position 105 or 106 shown in FIG. 4, the first and second engaging members 74 and 76 are disengaged from each other, and the sinker actuating member 30 is released from the needle moving mechanism 20. Consequently, the sinker actuating member 30 is abutted on the first stopper portion 46 under the spring force of the resilient member 114, and the sinker 18 is held at the pressing position A.

Figure 11D:
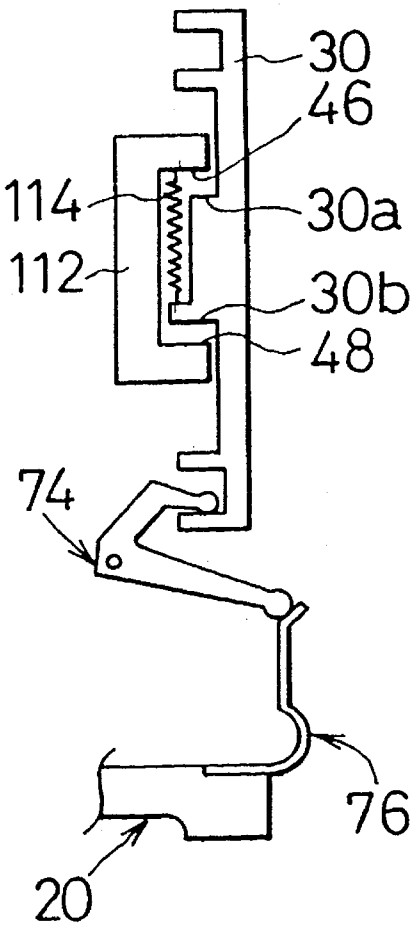
FIGS. 11 (A) to 11 (D) are similar views but illustrating the operation of the actuating apparatus of FIG. 9 when the knitting needle is moved backward.
Figure 11C:
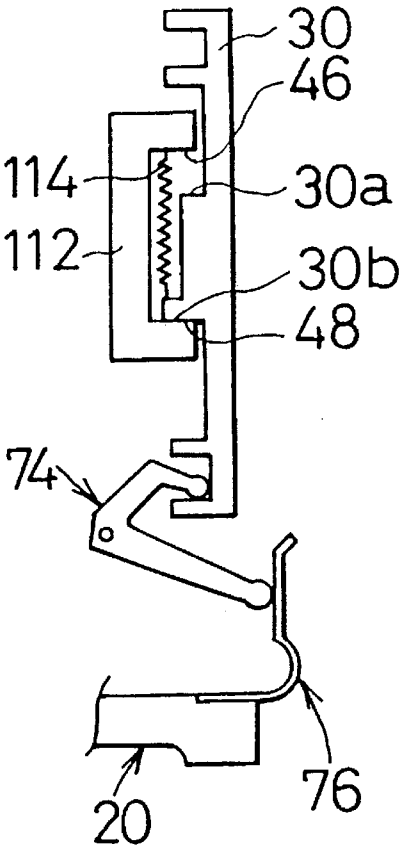
Figure 11B:
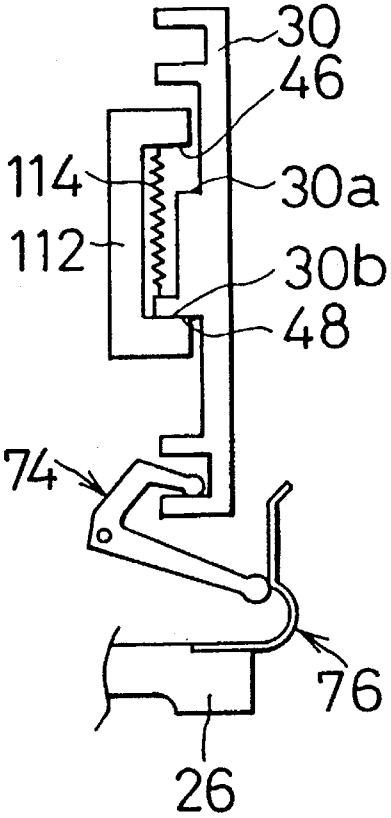
Figure 11A:
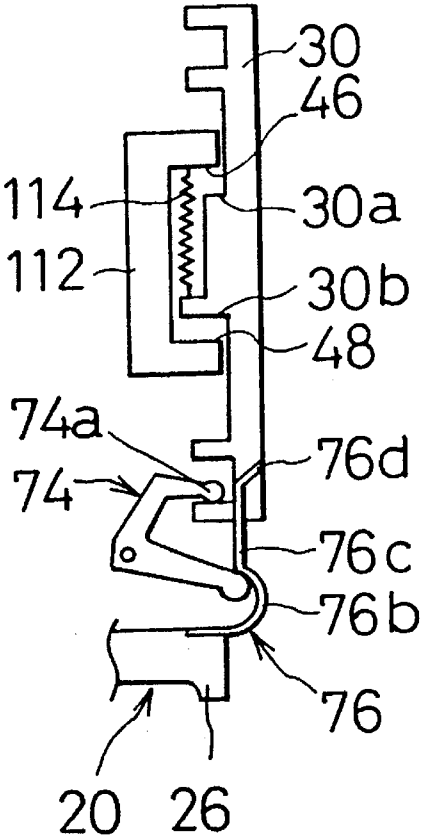

As shown in FIG. 11(A), while the knitting needle 14 is thereafter retracted from the most advanced position 106 to the position 107 shown in FIG. 4, the second engaging member 76 is retracted with the engaging portion 74*a* of the first engaging member 74 abutted on a boundary portion of the second engaging member 76 between the concave portion 76*b* and the flat portion 76*c*, and the sinker actuating member 30 is connected to the needle moving mechanism 20 by way of the first and second engaging members 74 and 76. Consequently, since the sinker actuating member 30 is acted upon by a retracting force of the needle moving mechanism 20, it is retracted together with the knitting needle 14, and the sinker 18 is displaced toward the position B where it releases the knitted fabric.

As shown in FIG. 11 (B), when the knitting needle 14 is retracted to the position 107 shown in FIG. 4, the abutting portion 30*b* of the sinker actuating member 30 is abutted on the retracted position stopper portion 48, whereby the sinker 18 is displaced to the releasing position B. Consequently, the knitted fabric 16 is released completely from the sinker 18. At the position 107, the flat portion 76*c* of the second engaging member 76 is abutted on the engaging portion 74*a* of the first engaging member 74.

As seen in FIG. 11 (C), while the knitting needle 14 is moved from the position 107 to the position 100 past the positions 108 and 109 shown in FIG. 4, the sinker actuating member 30 remains abutted on the second position stopper portion 48. Thus, as the knitting needle 14 is retracted, an excessive load exceeding the coupling force between the flat portion 76*c* of the second engaging member 76 and the engaging portion 74*a* of the first engaging member 74 acts upon the first and second engaging members 74 and 76. Consequently, since a slip occurs between the flat portion 76*c* of the second engaging member 76 and the engaging portion 74*a* of the second engaging member 76, the sinker actuating member 30 stops its retracting movement although the needle moving mechanism 20 and the knitting needle 14 are retracted. However, since the sinker actuating member 30 is acted upon by a retracting force originated from the slip between the first and second engaging members 74 and 76, it is held abutted on the second stopper portion 46 and holds the sinker 18 at the releasing position B.

As seen in FIG. 11 (D), when the knitting needle 14 is retracted to the position 100 shown in FIG. 4, the inclined portion 76*d* of the second engaging member 76 is abutted on the engaging portion 74*a* of the first engaging member 74. Thereby, the first engaging member 74 and the second engaging member 76 are disengaged from each other, and the sinker actuating member 30 is released from the needle moving mechanism 20 by the connecting mechanism 72, and the retracting force of the needle moving mechanism 20 does not act upon the sinker actuating member 30 any more. Consequently, the sinker actuating member 30 is acted upon and moved by an advancing force of the resilient member 114 until it is abutted on the stopper 94, thus holding the sinker 18 at the holding down position A. As a result, the knitted fabric is pressed by the sinker 18, and the old loop is kept in a condition of being prevented from riding up.

Thereafter, the knitting needle 14 is retracted to the most retracted position 101 shown in FIG. 4 and then advances to the standby position 102 shown in FIG. 4.

As described above, with any of the actuating apparatus 10, 0, 70 and 110, while a knitting needle 14 is advanced from the position 100 to the most advanced position 105 past the positions 101 to 104 shown in FIG. 4 and while the knitting needle 14 stays at the most advanced position 105 or 106 shown in FIG. 4, the corresponding sinker actuating member 30 holds the corresponding sinker under the advancing force of the needle moving mechanism 20 or the spring force 64 of the resilient member 38, 62, 92 or 114, and the knitted fabric is pressed by the sinker so that an old loop is prevented from riding up.

On the other hand, when the knitting needle 14 is retracted from the position 106 to the position 107 shown in FIG. 4, the sinker actuating member 30 is connected to the corresponding needle moving mechanism by the connecting mechanism, and is acted upon by a retracting force of the needle moving mechanism. Consequently, the sinker actuating member 30 is retracted against the spring force of the resilient member until it is abutted on the second stopper portion 48, and moves the sinker 18 to its releasing position B. Thereby, the knitted fabric is released from the pressing by the sinker 18.

Further, the sinker actuating member 30 holds the sinker 18 at the releasing position B until the knitting needle 14 is retracted from the position 107 to the position 100 shown in FIG. 4. When the knitting needle 14 is retracted to the position 100 shown in FIG. 4, the sinker actuating member 30 is advanced relative to the needle moving mechanism by the spring force of the resilient member, and displaces the sinker 18 to the pressing position A and holds it there.

In the embodiments described above, the sinker actuating apparatus employs a mechanical connecting mechanism which employs friction engaging members which are mechanically engaged with each other. However, it may employ instead some other connecting mechanism such as a magnetic connecting mechanism which employs friction engaging members engaged with each other with a magnetic force.

Figure 12:
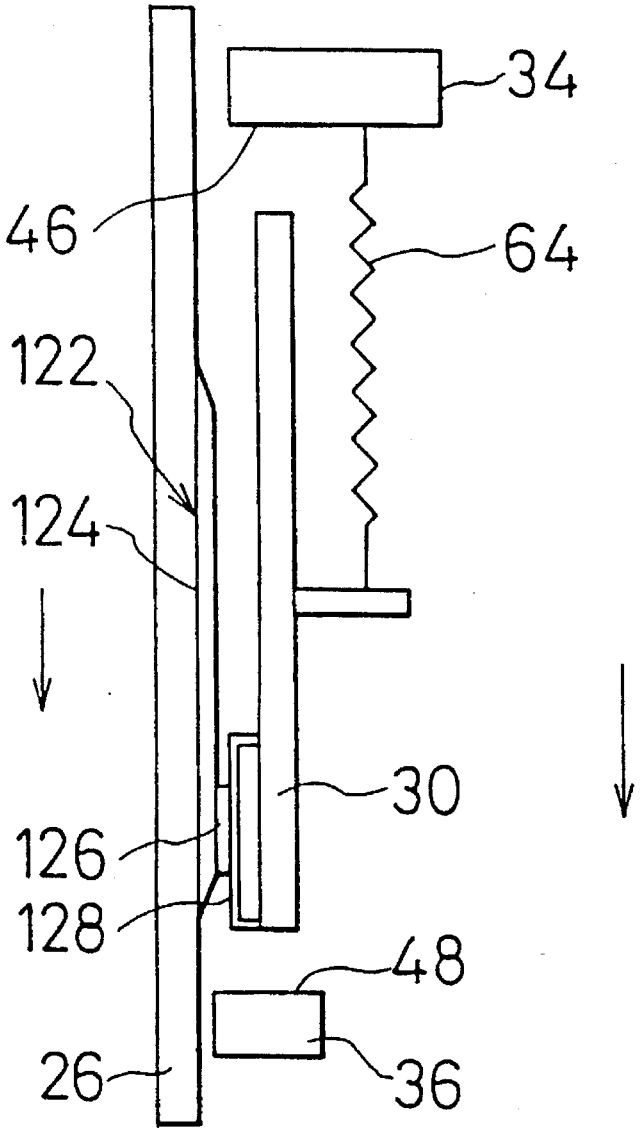
FIG. 12 is a schematic view showing an actuating apparatus according to a yet further preferred embodiment of the present invention.

A connecting mechanism 122 shown in FIG. 12 includes first and second engaging members 124 and 126 which are magnetically engaged with each other. The first engaging member 124 is a permanent magnet in the form of an elongated plate magnetized in the direction of thickness, and is mounted on the connecting jack 26 of a needle actuating mechanism so as to extend in a longitudinal direction of the connecting jack 26 and so as not to move relative to the connecting jack 26. Meanwhile, the second engaging member 126 is a ferromagnetic plate member attracted by a magnetic force to the first engaging member 124, and is mounted on the sinker actuating member 30 by way of a leaf spring 128 so as to be opposed to the first engaging member 124. Also the connecting mechanism 122 shown in FIG. 12 operates in a similar manner to those of the connection mechanisms in the embodiments described above.

it is to be noted that the connecting mechanism 122 shown in FIG. 12 may be modified such that the second engaging member 126 is formed as a permanent magnet in the form of a plate magnetized in the direction of thickness while the first engaging member 124 is formed as a ferromagnetic elongated plate member or that the first engaging member 124 in the form of a plate-like permanent magnet is mounted on the sinker actuating member 30 while the second engaging member 126 in the form of a ferromagnetic plate member is mounted on the connecting jack 26.

Variations and modifications can be made to the invention within the spirit and scope of claims as set forth herein.

What is claimed is:

1. A pressing sinker actuating apparatus for a knitting machine which includes a plurality of knitting needles disposed on a needle bed so as to move forward and backward, a plurality of movable sinkers disposed on said needle bed so as to displace between a pressing position where the sinker presses a knitted fabric and a releasing position where the sinker releases the knitted fabric, and needle moving means for reciprocating said knitting needles, comprising:

sinker actuating means disposed on said needle bed so as to move forward and backward to displace the sinker between the pressing position and the releasing position;

connecting means for non-fixedly connecting said sinker actuating means to a corresponding one of said needle moving means to move said sinker actuating means in response to the movement of the needle moving means;

stopper means having a first stopper portion for restricting an advanced position and a second stopper portion for restricting a retracted position of said sinker actuating means; and a resilient member provided for giving an advancing force to said sinker actuating means;

wherein said second stopper portion is formed at a position where said second stopper portion hinders the retracting movement of said sinker actuating means when the corresponding knitting needle is retracted by a predetermined distance from a most advanced position thereof;

wherein said connecting means disconnects said sinker actuating means from the needle moving means before the corresponding knitting needle is retracted to a position where the knitting needle forms a needle loop after said sinker actuating means is abutted on said second stopper portion; and wherein said resilient member has a spring force lower than a connecting force between said sinker actuating means and the needle moving means by said connecting means.

2. A sinker actuating apparatus according to claim 1, wherein said first stopper portion is formed at a position where said sinker actuating means displaces the sinker to the pressing position while said sinker actuating means is abutted on said first stopper portion.

3. A sinker actuating apparatus according to claim 1, wherein said connecting means includes first and second engaging members disposed for mechanical engagement or magnetical engagement with each other, and one of said first and second engaging members is connected to said sinker actuating means while the other of said first and second engaging means is connected to the corresponding needle moving means.

4. A sinker actuating apparatus according to claim 3, wherein said first engaging member is connected to the corresponding needle moving means while said second engaging member is connected to said sinker actuating means.

5. A sinker actuating apparatus according to claim 3, wherein said first engaging member is connected to said sinker actuating means while said second engaging member is connected to the corresponding needle moving means.

6. A sinker actuating apparatus according to claim 3, wherein said first and second engaging members are engaged mechanically and frictionally with each other.

7. A sinker actuating apparatus according to claim 3, wherein said first and second engaging members are magnetically engaged with each other.

* * * * *

UNITED STATES PATENT AND TRADEMARK OFFICE

CERTIFICATE OF CORRECTION

PATENT NO. : 5,570,592
DATED : November 5, 1996
INVENTOR(S) : Yujiro Takegawa

It is certified that error appears in the above-indentified patent and that said Letters Patent is hereby corrected as shown below:

Title page, item '[57] ABSTRACT' Line 6, "stopper" should read --stoppers--.

Column 1 Line 16 "tile" should read --the--.

Column 1 Line 33 "5-10247" should read --6-10247--.

Column 1 Line 35 "Lo" should read --to--.

Column 1 Line 46 "tile" should read --the--.

Column 2 Line 10 "tile" should read --the--.

Column 2 Line 42 "at," should read --at--.

Column 3 Line 34 "second d" should read --second--.

Column 4 Line 1 "5(E)" should read --6(E)--.

Column 4 Line 14 "or" should read --of--.

Column 4 Line 29 "fiat" should read --flat--.

Column 4 Line 50 "the" should read --The--.

Column 5 Line 7 "herein" should read --wherein--.

Column 6 Line 19 after "54" insert --.--.

Column 6 Line 31 after "mechanism" insert --32.--.

UNITED STATES PATENT AND TRADEMARK OFFICE

CERTIFICATE OF CORRECTION

PATENT NO. : 5,570,592
DATED : November 5, 1996
INVENTOR(S) : Yujiro Takegawa

It is certified that error appears in the above-indentified patent and that said Letters Patent is hereby corrected as shown below:

Column 7 Line 4 "of 62" should read --or 62--.

Column 7 Line 9 "PIG." should read --FIG.--.

Column 8 Line 6 "105" should read --106--.

Column 8 Line 59 "54." should read --64.--.

Column 9 Line 39 "he advanced" should read --the advanced--.

Column 9 Line 52 "10(C)and" should read --10(C) and--.

Column 11 Line 42 "0," should read --60,--.

Column 12 Line 29 "it" should read --It--.

Signed and Sealed this

Eighteenth Day of February, 1997

*Attest:*

*Attesting Officer*

BRUCE LEHMAN

*Commissioner of Patents and Trademarks*